US008967609B2

(12) United States Patent
Arendt

(10) Patent No.: US 8,967,609 B2
(45) Date of Patent: Mar. 3, 2015

(54) METHOD FOR OPERATING A THREAD STITCHING MACHINE

(71) Applicant: Mueller Martini Holding AG, Hergiswil (CH)

(72) Inventor: Holger Arendt, Grossrinderfeld (DE)

(73) Assignee: Mueller Martini Holding AG, Hergiswil (CH)

( * ) Notice: Subject to any disclaimer, the term of this patent is extended or adjusted under 35 U.S.C. 154(b) by 38 days.

(21) Appl. No.: 13/867,151

(22) Filed: Apr. 22, 2013

(65) Prior Publication Data

US 2013/0277906 A1 Oct. 24, 2013

(30) Foreign Application Priority Data

Apr. 24, 2012 (CH) ..... 561/12

(51) Int. Cl.

| | |
|---|---|
| ***B42B 2/00*** | (2006.01) |
| ***B42B 2/02*** | (2006.01) |
| ***B42C 1/12*** | (2006.01) |
| ***B65H 39/02*** | (2006.01) |
| ***B65H 5/32*** | (2006.01) |

(52) U.S. Cl.

CPC ... *B42B 2/00* (2013.01); *B42B 2/02* (2013.01); *B42C 1/12* (2013.01); *B65H 39/02* (2013.01); *B65H 5/32* (2013.01)

USPC ..... 270/52.18; 270/52.26; 270/52.3; 270/37

(58) Field of Classification Search

USPC ..... 270/37, 52.18, 52.19, 52.2, 52.21, 270/52.22, 52.26, 52.3

See application file for complete search history.

(56) References Cited

U.S. PATENT DOCUMENTS

| | | | | |
|---|---|---|---|---|
| 4,041,883 | A * | 8/1977 | Meratti | 112/21 |
| 5,887,863 | A | 3/1999 | Hollenstein et al. | |
| 7,261,507 | B2 * | 8/2007 | Horii et al. | 412/35 |
| 8,220,793 | B2 * | 7/2012 | Mezger | 270/52.3 |
| 2010/0117286 | A1 * | 5/2010 | Mezger | 270/37 |
| 2011/0079159 | A1 | 4/2011 | Silberbauer et al. | |

FOREIGN PATENT DOCUMENTS

| | | | |
|---|---|---|---|
| EP | 2305485 | A1 | 4/2011 |
| WO | WO 9703906 | A | 2/1997 |

* cited by examiner

*Primary Examiner* — Leslie A Nicholson, III

(74) *Attorney, Agent, or Firm* — Leydig, Voit & Mayer, Ltd.

(57) ABSTRACT

A method for operating a thread stitching machine for processing printed sheets to form book blocks includes providing at least one sewing station with an active connection to at least one stitching saddle and providing the at least one stitching saddle with an active connection to at least one transporting system. The printed sheets are supplied to the at least one stitching saddle, using the at least one transporting system, in at least one of a substantially vertical and a substantially horizontal plane relative to the at least one stitching saddle. At least the printed sheets in the substantially vertical plane are supplied directly onto the at least one stitching saddle or to a region of the at least one stitching saddle. The printed sheets are supplied to the at least one sewing station resting astride the at least one stitching saddle.

15 Claims, 2 Drawing Sheets

METHOD FOR OPERATING A THREAD STITCHING MACHINE

CROSS-REFERENCE TO PRIOR APPLICATION

Priority is claimed to Swiss Patent Application No. CH 00561/12, filed on Apr. 24, 2012, the entire disclosure of which is hereby incorporated by reference herein.

FIELD

The invention relates to a method for operating a thread stitching machine for processing printed sheets into book blocks, the thread stitching machine substantially consisting of at least one transporting system for the printed sheets and at least one sewing station, the sewing station having an active connection to at least one stitching saddle, the stitching saddle in turn having an active connection to the transporting system for the printed sheets, the signatures processed in the sewing station being supplied in a vertical or virtually vertical and/or in a horizontal or virtually horizontal plane relative to the stitching saddle, and the (folded) printed sheets being supplied to the sewing station resting astride the stitching saddle. The invention furthermore relates to a thread stitching machine for carrying out the method for processing printed sheets into book blocks.

BACKGROUND

Thread stitching machines have become known, to which printed sheets can be supplied both manually and automatically onto the stitching saddle. Thread stitching machines are known, to which folded printed sheets can be automatically supplied from a printing machine onto the stitching saddle.

A known thread stitching machine can be operated inline and/or offline. In this variant, the loading of the stitching saddle does not take place by means of an additional feed device, but laterally by means of an auxiliary saddle (horizontal loading). A digital printing machine or a folding machine, which places the folded and opened printed sheets directly on the auxiliary saddle, can be connected, for example, to the auxiliary saddle. A conveyor chain then transports the printed sheet to the stitching saddle, and a shoot-in roller or a transporting belt then conveys the printed sheet to the stitching saddle. In this case, only a plurality of printed sheets can be stitched one behind the other or individual signatures processed. A preliminary collection can take place on the auxiliary saddle, or unfolded signatures can be collected and then placed thereon. However, collected individual signatures coming from the digital printing machine can be guided onto the stitching saddle and stitched there.

SUMMARY

In an embodiment, the present invention provides a method for operating a thread stitching machine for processing printed sheets to form book blocks. At least one sewing station is provided with an active connection to at least one stitching saddle. The at least one stitching saddle is provided with an active connection to at least one transporting system. The printed sheets are supplied to the at least one stitching saddle, using the at least one transporting system, in at least one of a substantially vertical and a substantially horizontal plane relative to the at least one stitching saddle. At least the printed sheets in the substantially vertical plane are supplied directly onto the at least one stitching saddle or to a region of the at least one stitching saddle. The printed sheets are supplied to the at least one sewing station resting astride the at least one stitching saddle.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

Figure 1:
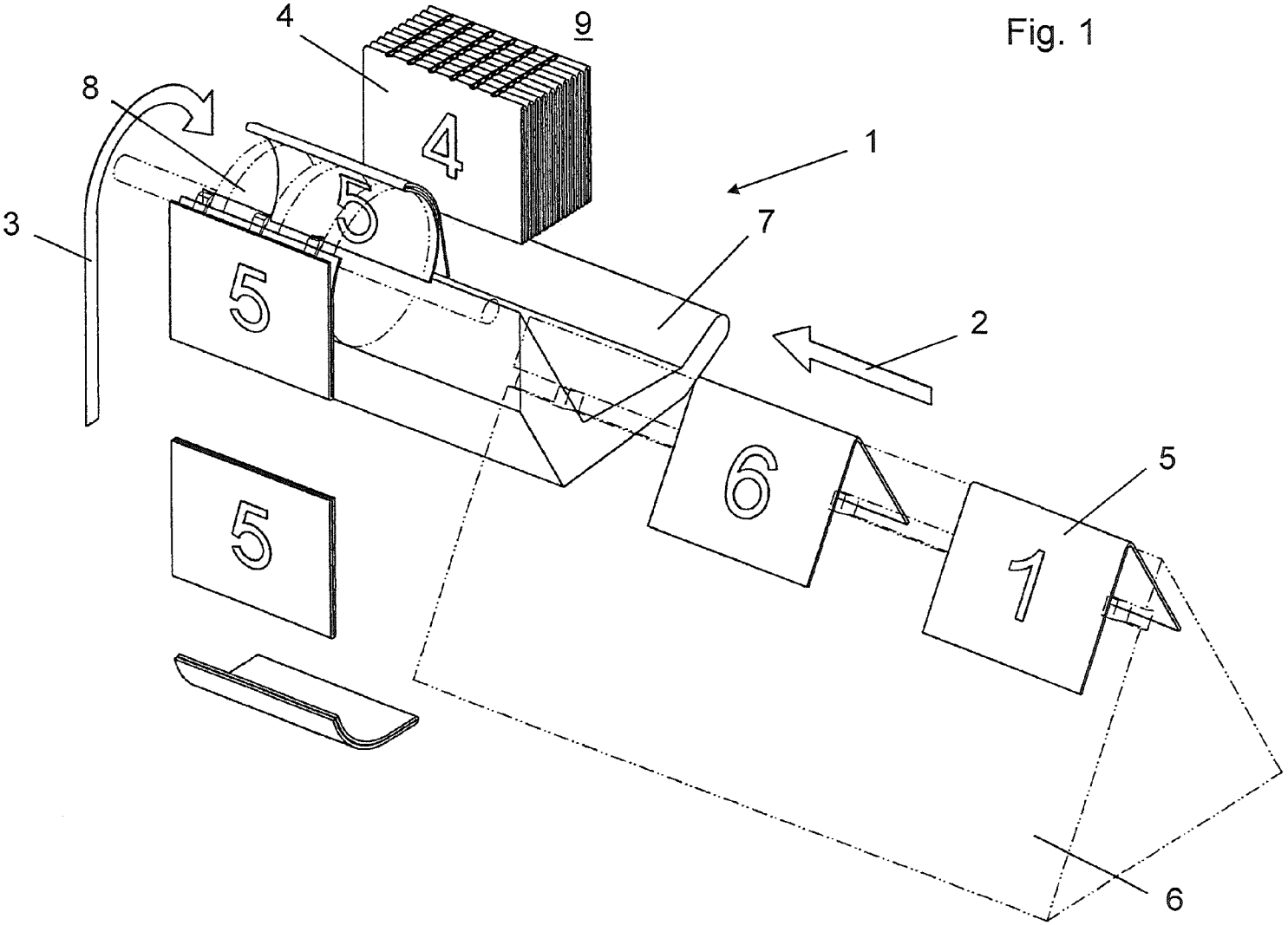
FIG. 1 shows a thread stitching machine which is operated inline/offline/combined with an external and internal printed sheet supply.

It is currently not possible to supply the stitching saddle of a thread stitching machine with printed sheets from two different directions. However, the present invention recognizes that this would be advantageous, if it is wished to process different formats, such as, for example, often requested in art printing, within one book. In this case, conventional thread stitching machines very quickly reach their limits, as they can always only be set up for one format.

According to an embodiment, the invention provides a thread stitching machine, which is in a position to deal with the printed sheets supplied to the stitching saddle from at least two different directions.

For this purpose, a method for operating a thread stitching machine is proposed for processing signatures into book blocks, the thread stitching machine substantially consisting of at least one transporting system for the signatures and of at least one adjoining sewing station.

The sewing station itself is operated with an active connection to at least one stitching saddle, this stitching saddle in turn having an active connection to the transporting system for the signatures. The signatures processed in the sewing station are supplied in a vertical or virtually vertical and/or in a horizontal or virtually horizontal plane relative to the stitching saddle, and the signatures are supplied to the sewing station resting astride the stitching saddle. At least the vertical or virtually vertical supply of the signatures takes place directly to the stitching saddle or it is carried out in the region of the stitching saddle.

Basically, the thread stitching machine according to an embodiment of the invention is configured such that the signatures supplied later to the sewing station, also called printed sheets, are primarily dealt with by a feed device operating in the vertical direction, the printed sheet supply of which is always directed onto the stitching saddle. A feed device of this type will preferably have the form of a gripping drum, which is advantageously arranged above the stitching saddle.

This configuration according to an embodiment of the invention does not, in the meantime, exclude the possibility of also providing, within a loading process of this type, horizontally operating devices, which take on the printed sheet supply, for example in an intermediary manner, to the stitching saddle.

In this case, preferably two types of feed devices are paramount for carrying out a horizontal printed sheet supply of this type.

The method that has become known from the prior art consists in carrying out the horizontal feeding of the printed sheets, even in the case of an intermediary supply, by means of a stationary auxiliary saddle.

A further possibility for carrying out the horizontal supply consists in carrying out the final pushing of the printed sheets onto the stitching saddle with a compact feed device, which is arranged laterally of the stitching saddle, may substantially also have the form of a gripper drum and has kinematics allowing the printed sheet to firstly be brought into position relative to the stitching saddle to be loaded, and this printed sheet to then be pushed directly onto the stitching saddle by a horizontally acting element. So that the horizontal loading of the stitching saddle by means of this feed possibility does not collide in terms of space with the auxiliary saddle or with the gripper drum already provided and operating vertically above the stitching saddle in the loading position, the vertically/horizontally acting feed device mentioned should be arranged on the other front side of the stitching saddle.

According to an embodiment of the invention, it is taken as a basis that at least one vertical supply of the printed sheets is carried out in the closest and direct cooperation with the stitching saddle in such a way that, basically, purely by a vertical supply of this type, all the printed sheets forming the book block can be supplied. This makes sense, in particular, when the book block consists of uniformly configured and formatted printed sheets, which allows a very high feed rate.

However, it is frequently the case that the book blocks may contain different addenda or supplements, in which a targeted intermediary supply has to take place. An intermediary supply of this type of specially configured printed sheets can also readily be achieved by means of the vertical feed device, i.e. by means of the gripper drum, either directly onto the stitching saddle or with an additional horizontal feed.

According to an embodiment of the invention, the following feed types can be provided in such cases:

Vertical feeding of the printed sheets forming one book block, whether of the same type or provided with special inserts, can be achieved by means of a feed device, preferably by means of a gripper drum, which operates substantially above the stitching saddle located in the loading position.

In addition to an integral vertical feed of all the printed sheets directly onto the stitching saddle, a horizontal supply may also be provided, which supplies other supplementary printed sheets in an intermediary manner, and which printed sheets can also be pushed directly onto the stitching saddle.

Such intermediary supplies may also be carried out by means of a stationary auxiliary saddle, their supply taking place to the side of the stitching saddle, and the stitching saddle being able to be arranged either to the left or right or on either side of the stitching saddle, a high diversity of configuration being achievable by this with regard to different printed sheets. It is also possible in this configuration for the printed sheets to be supplied to the auxiliary saddle by means of a vertically acting feed device, preferably by means of a further gripper drum.

If the printed sheets are fed to the stitching saddle by means of the two supply planes, in other words vertically and horizontally or vertically/vertically/horizontally, the feeding can be achieved by means of intermediary cyclical sequences, which lead to an increase in productivity. It is a product-dependent arrangement here, from which direction the predominant part of the printed sheets is to be supplied.

The thread stitching machine according to an embodiment of the invention has the ability to supply the printed sheets both automatically from the magazine by means of a gripper drum (vertically), and manually/automatically from a printing machine/folding apparatus by means of an auxiliary saddle (horizontally) to the stitching saddle.

The thread stitching machine according to an embodiment of the invention is furthermore able to supply printed sheets within a production simultaneously vertically and horizontally onto the stitching saddle or an auxiliary saddle.

The thread stitching machine according to an embodiment of the invention is furthermore able to reliably process a plurality of different formats within a book block.

For this purpose, a transporting section for printed sheets is proposed, which is operated between an opener system acting upstream and a sewing station arranged downstream. This transporting section substantially consists of an auxiliary saddle and a downstream stitching saddle. The auxiliary saddle and stitching saddle are designed as autonomously acting part transporting sections, which, however, with regard to the transporting of the printed sheets have an operating independence according to an embodiment of the invention. This mode of operation according to the invention is per se independent of whether purely "normal format" printed sheets are transported, or whether "below-format" printed sheets intermittently arrive for processing.

In general, the thread stitching machine according to an embodiment of the invention is distinguished in that the vertical feeding, which can preferably take place by means of a gripper drum, can take on the loading both of the stitching saddle and of the auxiliary saddle.

The site of use of a gripper drum of this type can be provided in different ways: for example above the stitching saddle located in the loading position or to the side thereof.

FIG. 1 shows a method for operating a thread stitching machine 1 inline/offline/combined, with an external and internal printed sheet supply 2, 3 with, for example, various formats within a book block 4. For example, six folded signatures 5 are to be processed to form a book block, wherein five signatures (No. 1, 2, 3, 4, and 6) have the same format and are to be supplied automatically by a digital printing machine. Signature No. 5 has a smaller format and, in order to avoid a time-consuming compilation with the other signatures, is to be directly supplied to the processing operation of the thread stitching machine 1. The signatures No. 1, 2, 3, 4 and 6, coming from the digital printing machine, are placed folded one after the other on the auxiliary saddle 6 and drawn or shot one after the other horizontally onto the stitching saddle 7 in cycles. This takes place in the order 1, 2, 3, 4, 0, 6. 0 means that a gap is allowed in the auxiliary saddle supply process after the fourth signature in the form of an idle cycle in order to make room for the signature No. 5 on the stitching saddle 7. All the signatures No. 5 are placed in the internal magazine of the thread stitching machine 1, drawn off, guided through, with the open side leading, below the stitching saddle 7 with the open side leading, deflected upwardly by 90°, opened and conveyed vertically onto the stitching saddle by the gripper drum. The gripper drum 8 only works in the fifth cycle, as it is controlled by a servomotor. During the idle cycle of the auxiliary saddle 6, in which the stitching saddle 7 is not loaded horizontally, the gripper drum 8 conveys the signature No. 5 vertically onto the stitching saddle 7 and therefore closes the gap in the printed sheet run. In the next cycle, the sixth and last signature of the book is supplied horizontally again by means of the auxiliary saddle. The process then begins again.

Figure 2:
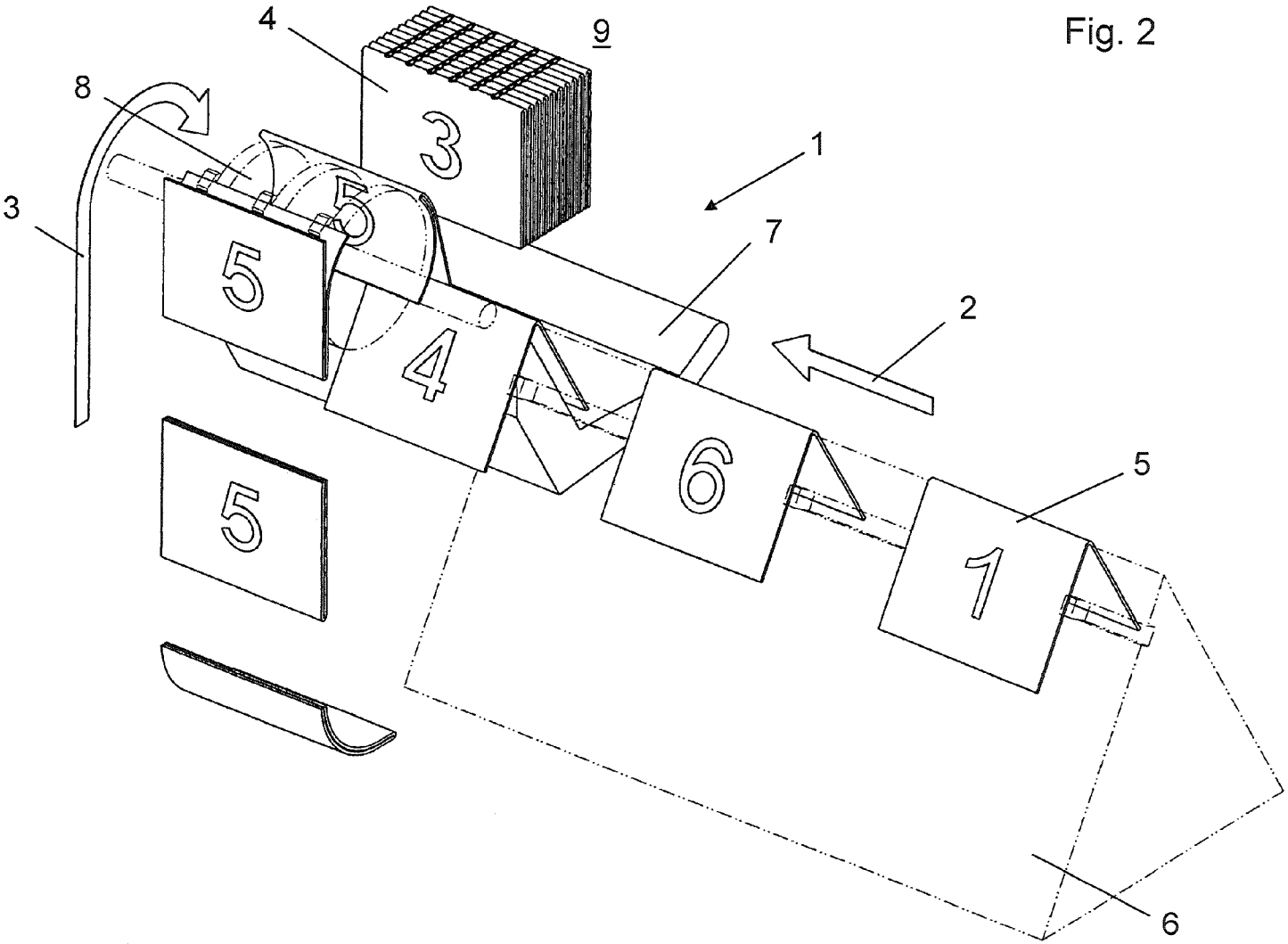
FIG. 2 shows a thread stitching machine, inline/offline/combined with an external and internal printed sheet supply, with various formats within a book block.

FIG. 2 shows a method for operating a thread stitching machine 1 inline/offline/combined, with an external and internal printed sheet supply 2, 3, with, for example, various formats within a book block 4, wherein the printed sheets are to be stitched both one behind the other and one above the other in a book. This means: printed sheets with different formats have to be able to be inserted into one another on the stitching saddle 7: for example, six folded signatures are to be processed into a book block of five printed sheets, wherein five signatures (No. 1, 2, 3, 4 and 6) have the same format and are to be automatically supplied by a digital printing machine. Signature No. 5 could, for example, be an art print, has a smaller format and is to be placed over signature No. 4. This corresponds to an insertion of signature No. 4 in signature No. 5. In order to avoid a time-consuming compilation or insertion by hand with the other signatures, the special signature No. 5 is to be supplied directly to the processing operation of the thread stitching machine. The signatures No. 1, 2, 3, 4 and 6, coming from the digital printing machine, are placed folded one after the other on the auxiliary saddle 6 and drawn or shot one after the other horizontally onto the stitching saddle 7 in cycles. This takes place in the order 1, 2, 3, 4, 6. This time, no idle cycle on the auxiliary saddle 6 is necessary as signature 5 is to be placed above signature 4. All the signatures No. 5 are placed in the internal magazine of the thread stitching machine 1, drawn off, guided through, with the open side leading below the stitching saddle 7, deflected upwardly by 90°, opened and conveyed vertically onto the stitching saddle 7 by the gripper drum 8. The gripper drum 8 works only in the fourth cycle, as it is controlled by a servomotor.

The signatures 1, 2 and 3 in FIG. 2 are now, one after the other, drawn in or shot horizontally onto the stitching saddle 7 by means of the auxiliary saddle 6 and stitched one after the other. While signature No. 4 is now supplied horizontally to the stitching saddle 7, at the same time, signature No. 5 is placed vertically on the stitching saddle 7 and therefore over signature No. 4. The front edge of signature No. 4, in the process, has previously geometrically passed the rear edge of signature No. 5 fed from above, so that no collision occurs. Thus, the two signatures are inserted in one another and can now be stitched to signature No. 3. Thereafter, the gripper drum 8 stands still and signature No. 6 is conveyed horizontally onto the stitching saddle 7 again in the next and last cycle. The process can now begin again.

The process described below corresponds to a simultaneously loading of the stitching saddle with two printed sheets of different formats both by means of the gripper drum and also by means of the auxiliary saddle within a machine cycle. The two printed sheets are inserted into one another on the stitching saddle and then stitched to the preceding signature.

To facilitate understanding, the process starts at 1° and ends at 360°. At the beginning of the process, both the auxiliary saddle and the gripper drum are equipped with one signature each and are to be supplied to the stitching saddle:

1°: The stitching saddle reaches the loading position.

2°-45°: The printed sheet front edge of signature 4 which is located on the auxiliary saddle reaches the stitching saddle and is accelerated by means of the shoot-in roller in the direction of the printed sheet stop.

20°-85°: The printed sheet lower edge of signature 5 which is located on the gripper drum reaches the stitching saddle tip and is placed on the stitching saddle. At this time, the printed sheet front edge of signature 4 has already passed the printed sheet rear edge of signature 5, so a collision of the two printed sheets cannot occur. While signature 4 now reaches the printed sheet stop, signature 5 is simultaneously placed above it. The two printed sheets are now inserted in one another.

86°-170°: The stitching saddle travels with an active connection to a sewing station 9 into the stitching position. During this time, the two printed sheets are oriented by means of the cam-controlled head stop.

171°-285°: The two signatures are together stitched to the preceding signature.

286°-360°: The stitching saddle travels back into the loading position. The process can now begin again.

Moreover, using the subject matter according to embodiments of the invention, thread stitching machines can optionally be extended and can have various concepts. The variants described here, which are not shown in more detail by figures, can readily be grasped by a person skilled in the art and they are not to be understood as conclusive concepts.

One variant relates to a thread stitching machine, which is operated offline. This version is the traditional type of thread stitching machine. The stitching saddle is supplied from one or more magazines of its own. It is insignificant in this case whether traditional thread stitching (stitching a plurality of printed sheets one behind the other) or collective stitching (stitching a plurality of printed sheets one above the other) is practiced here. The machine is not connected to the outside world, but rather produces in a non-integrated manner. The printed sheets are drawn off in this case in the magazine, placed on a transporting belt and guided through with the open side leading below the stitching saddle, upwardly deflected by 90°, opened, grasped by the gripper drum, deflected about their own axis and placed on the stitching saddle (vertical loading) and then stitched one behind the other or one above the other.

A further variant relates to a thread stitching machine which is operated inline/offline/combined. In this variant, the loading takes place either simultaneously vertically by means of the gripper drum and horizontally by means of the auxiliary saddle (one signature drawn or shot laterally onto the stitching saddle and the other one placed vertically thereabove by means of the gripper drum) or else displaced in cycles, for example three signatures one behind the other from the auxiliary saddle, then one idle cycle from the auxiliary saddle and, in this idle cycle, one printed sheet is placed vertically by means of the gripper drum onto the stitching saddle; or, for example, four signatures one behind the other from the auxiliary saddle without an idle cycle and a further signature is placed vertically thereover over the last signature or another signature by the gripper drum. The combination possibilities are very diverse in this case and particularly suitable for processing at least two different formats in a book (art print) or else to be able to insert printed sheets of different formats inside one another.

A further variant relates to a thread stitching machine, which is operated inline with an external printed sheet supply. In this version, for example, five folded signatures, coming from a digital printing machine or a folding machine, are to be processed to form a book block. The digital printing machine or folding machine which is laterally docked onto the auxiliary saddle of the thread stitching machine takes on the folding and placing on of the printed sheets in this case. The folded signatures are placed opened in the order 1, 2, 3, 4, 5 one after the other on the auxiliary saddle and pushed individually by means of a conveyor chain in the direction of the stitching saddle. The transporting length of a conveyor chain strand corresponds in this case to one stitching machine cycle. The first conveyor now pushes the printed sheet to be stitched onto the auxiliary saddle located in the loading position. At the beginning of the stitching saddle, the signature is either shot by an accelerator roller onto the stitching saddle or drawn onto the stitching saddle by means of a belt transporting system. Thereafter, the stitching saddle moves into the stitching position and stitches the signature. After the signature has been stitched, the stitching saddle moves back into the loading position and the process begins again. The stitching saddle is loaded in this case, in a basic version, exclusively horizontally externally by means of the auxiliary saddle. The gripper drum, which is internal to the machine, for vertically loading the stitching saddle is initially not in operation, but can, if necessary, be put into operation at any time.

A further variant relates to a thread stitching machine, which is operated offline with an internal printed sheet supply. In this version, for example, four folded signatures are to be processed to form a book block. The signatures to be stitched are placed in the order 1, 2, 3, 4, etc., into the machine's own magazine and drawn off one after the other, guided through, with the open side leading, below the stitching saddle, guided upwardly by 90° in the direction of the stitching saddle, opened and rotated about their own axis by a gripper drum and placed on the stitching saddle. The supply of a printed sheet corresponds to one machine cycle=360°. After each signature has been placed on, the stitching saddle moves from the loading position into the stitching position and the signature is stitched. Thereafter, the process begins again. In this case, the loading of the stitching saddle takes place exclusively internally (vertically) by means of its own magazine and the gripper drum. The horizontal auxiliary saddle and any digital printing machine or folding machine which may be connected are therefore not in operation.

A further variant relates to a collective thread stitching machine, which is operated offline with an internal printed sheet supply. A brochure to be processed consists, for example, of three individually folded printed sheets, which are collected one above the other and then stitched with a stitch and are to be secured against release by an additional blank stitch. The folded printed sheets are placed into the magazine in the order 1, 2, 3, 1, 2, 3, etc., and drawn off one after the other, guided through, with the open side leading, below the stitching saddle, guided upwardly by 90° in the direction of the stitching saddle, opened and rotated by a gripper drum by approximately 180° and placed on the stitching saddle. The supply of one printed sheet corresponds to one machine cycle=360°. Once the first printed sheet has been placed on the stitching saddle, it remains in the loading position and "waits" for the next printed sheet. The second printed sheet is now placed over the first printed sheet and the third printed sheet is then placed thereabove by means of the servo-controlled stitching saddle of the collecting thread stitching machine. Once the last signature has been placed on, the stitching saddle moves out of the loading position into the stitching position and the brochure is stitched and a blank stitch is carried out. The process then begins again. In this case, the loading of the stitching saddle takes place exclusively internally (vertically) by means of its own magazine and the gripper drum. The horizontal auxiliary saddle and any digital printing machine or folding machine which may be connected are therefore not in operation.

The method for operating the thread stitching machine according to an embodiment of the invention has the following advantages:

The machine can be loaded within one production with at least two different formats. This is only possible by loading the stitching saddle from two different directions within one production.

The machine can be operated both inline and offline (standalone).

The machine can be operated simultaneously inline and offline (combined).

The machine can carry out both traditional thread stitching and collective thread stitching.

The machine can combine traditional thread stitching and collective thread stitching (inserting printed sheets into one another and stitching printed sheets one above the other and one behind the other within one production).

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B." Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise.

What is claimed is:

1. A method for operating a thread stitching machine for processing printed sheets to form book blocks, the method comprising:

supplying the printed sheets to at least one stitching saddle that is associated with at least one sewing station, the printed sheets being supplied in a substantially vertical and a substantially horizontal plane relative to the at least one stitching saddle, the printed sheets in the substantially vertical plane being supplied directly onto the at least one stitching saddle or to a region of the at least one stitching saddle and the printed sheets in the substantially horizontal plane being supplied by at least one auxiliary saddle extending substantially to a side of the at least one stitching saddle; and supplying the printed sheets to the at least one sewing station resting astride the at least one stitching saddle.

2. The method according to claim 1, wherein the at least one stitching saddle is loaded with at least one of the printed sheets within a machine cycle.

3. The method according to claim 1, wherein the at least one stitching saddle is loaded with at least two of the printed sheets lying one above the other within a machine cycle.

4. The method according to claim 1, wherein the printed sheets supplied in the substantially vertical plane are variously dimensioned and configured, and are supplied directly onto the at least one stitching saddle via at least one feed device.

5. The method according to claim 4, wherein the at least one feed device is operated as a gripper drum.

6. The method according to claim 1, wherein at least one of the at least one auxiliary saddle and the at least one stitching saddle are loaded with the printed sheets at least one of horizontally and vertically.

7. The method according to claim 1, wherein the thread stitching machine is operated offline or inline.

8. The method according to claim 1, wherein the printed sheets in the substantially vertical plane are supplied by a gripper drum, and wherein a machine cycle, based on a full rotation of the gripper drum, comprises:

1°: the at least one stitching saddle reaches a loading position;

2°-45°: a printed sheet front edge of a first one of the printed sheets located on an auxiliary saddle reaches the at least one stitching saddle;

20°-85°: a printed sheet lower edge of a second one of the printed sheets located on the gripper drum reaches a tip of the at least one stitching saddle and is placed on the at least one stitching saddle, at which time, the printed sheet front edge of the first one of the printed sheets has already passed a printed sheet rear edge of the second one of the printed sheets so as to avoid a collision of the two printed sheets, and while the first one of the printed sheets now reaches the printed sheet stop, the second one of the printed sheets is simultaneously placed above the first one of the printed sheets such that the two printed sheets are inserted in one another;

86°-170°: the at least one stitching saddle travels to the at least one sewing station into a stitching position, during which, the two printed sheets are oriented;

171°-285°: the two printed sheets are together stitched to preceding ones of the printed sheets; and 286°-360°: the at least one stitching saddle travels back into the loading position for a subsequent machine cycle.

9. The method according to claim 1, further comprising supplying at least one of the printed sheets in the substantially vertical plane during an idle machine cycle of the at least one auxiliary saddle.

10. The method according to claim 9, wherein the at least one of the printed sheets supplied during the idle machine cycle of the at least one auxiliary saddle has a different format than the printed sheets that are supplied by the at least one auxiliary saddle.

11. A thread stitching machine for carrying out a method for processing printed sheets into book blocks, the thread stitching machine comprising:

at least one stitching saddle at least one sewing station associated with the at least one stitching saddle;

a feed device associated with the at least one stitching saddle and configured to supply at least one of the printed sheets to be processed in the at least one sewing station in a substantially vertical relative to the at least one stitching saddle directly onto the at least one stitching saddle or to a region of the at least one stitching saddle; and an auxiliary saddle disposed substantially to a side of the at least one stitching saddle and configured to supply at least one of the printed sheets to be processed in the at least one sewing station in the substantially horizontal plane relative to the at least one stitching saddle, wherein the printed sheets are supplied to the at least one sewing station resting astride the at least one stitching saddle.

12. The thread stitching machine according to claim 11, wherein the feed device is configured to supply variously dimensioned and configured ones of the printed sheets in the substantially vertical plane directly onto the at least one stitching saddle.

13. The thread stitching machine according to claim 12, wherein the feed device is a gripper drum.

14. The thread stitching machine according to claim 11, wherein the feed device is configured to supply the at least one of the printed sheets in the substantially vertical plane during an idle machine cycle of the at least one auxiliary saddle.

15. The thread stitching machine according to claim 14, wherein the at least one of the printed sheets supplied during the idle machine cycle of the at least one auxiliary saddle has a different format than the printed sheets that are supplied by the at least one auxiliary saddle.

* * * * *